US006857616B1

(12) United States Patent
Gasperi et al.

(10) Patent No.: US 6,857,616 B1
(45) Date of Patent: Feb. 22, 2005

(54) DEVICE FOR ATTACHING A BAR OF SOAP TO A MAGNETIC SOAP HOLDER

(75) Inventors: Nancy R. Gasperi, Racine, WI (US); Michael L. Gasperi, Racine, WI (US); Steven S. Cascio, Kenosha, WI (US)

(73) Assignee: Noveletti, LLC, Centennial, CO (US)

( * ) Notice: Subject to any disclaimer, the term of this patent is extended or adjusted under 35 U.S.C. 154(b) by 10 days.

(21) Appl. No.: 10/194,759

(22) Filed: Jul. 11, 2002

Related U.S. Application Data

(60) Provisional application No. 60/304,723, filed on Jul. 11, 2001.

(51) Int. Cl.[7] ..... A47G 29/00

(52) U.S. Cl. ..... 248/683; 248/686; 248/309.4

(58) Field of Search ..... 294/1.1, 65.5; 248/682, 683, 686, 206.5, 309.4; 411/372.6, 374, 429, 372.5, 373; 510/100, 143

(56) References Cited

U.S. PATENT DOCUMENTS

| | | | | | |
|---|---|---|---|---|---|
| 555,300 | A | * | 2/1896 | Browne | 220/284 |
| 606,024 | A | * | 6/1898 | Peraglie et al. | 248/686 |
| 624,809 | A | * | 5/1899 | Howe | 248/309.2 |
| 658,991 | A | * | 10/1900 | Langguth | 248/686 |
| 857,570 | A | * | 6/1907 | Allen | 248/684 |
| 1,400,421 | A | * | 12/1921 | Colomb | 368/237 |
| 2,597,925 | A | | 5/1952 | Edger | |
| 2,663,213 | A | * | 12/1953 | Davidson et al. | 411/435 |
| 2,825,177 | A | | 3/1958 | Nordlof et al. | |
| 2,988,841 | A | * | 6/1961 | Seufert et al. | 248/686 |
| 3,169,743 | A | | 2/1965 | Page, Jr. | |
| 3,289,990 | A | | 12/1966 | Grantham | |
| 3,472,391 | A | | 10/1969 | Bolognesi | |
| 3,552,705 | A | * | 1/1971 | Caster | 248/309.4 |
| D249,207 | S | | 9/1978 | Emmer | |
| D253,147 | S | | 10/1979 | Heckler | |
| D253,148 | S | | 10/1979 | Heckler | |
| D253,149 | S | | 10/1979 | Heckler | |
| 4,207,975 | A | | 6/1980 | Arzillo | |
| 4,400,123 | A | * | 8/1983 | Dunegan | 411/373 |
| D277,820 | S | | 3/1985 | Maayeh | |
| 4,861,505 | A | | 8/1989 | Farman | |
| D341,049 | S | | 11/1993 | Hugh | |
| 5,368,268 | A | | 11/1994 | Jodwischat | |
| 5,417,397 | A | | 5/1995 | Harnett | |
| D365,235 | S | | 12/1995 | Jodwischat | |
| D375,219 | S | | 11/1996 | Selent | |
| 5,642,871 | A | | 7/1997 | Repert et al. | |
| 5,752,795 | A | * | 5/1998 | D'Adamo | 411/429 |
| 5,947,439 | A | | 9/1999 | Florey | |
| D458,493 | S | | 6/2002 | Cascio | |
| D458,494 | S | | 6/2002 | Cascio | |

* cited by examiner

*Primary Examiner*—Dean J. Kramer
(74) *Attorney, Agent, or Firm*—Godfrey & Kahn, S.C.

(57) ABSTRACT

An improved cap style soap gripper for a magnetic soap holder including a hole in the side wall of the cap to facilitate insertion into a bar of soap and textured grooves on the inside surface to increase pullout force. A powder coating further increases the pullout force by increasing the surface energy of the cap. Elevating the temperature of the cap prior to insertion also facilitates the cap's insertion into a bar of soap and increases the required pullout force. A decreased diameter to height ratio, in addition, eases the insertion of the cap into a bar of soap, and lessens the effect of soap erosion.

9 Claims, 7 Drawing Sheets

DEVICE FOR ATTACHING A BAR OF SOAP TO A MAGNETIC SOAP HOLDER

CROSS REFERENCE TO RELATED APPLICATION

This application is based on and claims priority from U.S. Provisional Application Ser. No. 60/304,723, filed Jul. 11, 2001.

BACKGROUND OF THE INVENTION

This invention relates to a device for inserting into a bar of soap to make the bar of soap attractive to magnetic fields generated by a magnet from a magnetic soap holder, and specifically relates to a cap style gripping device.

Soap dishes are simple solutions for holding a bar of soap between uses. Soap lying in a dish or a holder on the edge of a sink with excess water from washing causes the soap to continue to dissolve reducing the useful life of the soap and leaving a coating on the dish or holder that requires periodic cleaning. Soap supporting features in soap dishes help, but they still get messy and require cleaning. Magnetic soap holders, like the present invention, were invented to solve this problem The concept of a magnetic soap holder has been around at least since at least 1947 when U. W. Edger invented a wall-mounted soap holder as shown in U.S. Pat. No. 2,597,925. A bar of soap is suspended from a magnet in the soap holder by a metallic anchor embedded into the bar of soap. Since that time many variations and improvements to the wall-mounted arrangement have been developed. Many design patents have been granted for wall-mounted magnetic soap holders as well.

One critical element in all magnetic soap holders is a metallic device attached to the bar of soap to make it attractive to magnetic fields. The device must be formed of a material that is both attracted to magnetic fields and inert to the caustic environment of the soap. The geometry of soap grippers typically fall into two categories: anchors and caps. Anchors are driven into the bar along the longitudinal axis of the bar, whereas caps are pressed into the bar on either of its two broad faces. The previously mentioned Edger patent and U.S. Pat. No. 3,289,990 to Grantham are good examples of anchor style grippers, while U.S. Pat. No. 2,825,177 to Nordlof shows a typical cap style gripper.

Anchor style soap grippers force the user to hang the soap in an unnatural vertical direction. The long dimension of a bar of soap can be over five times the thickness. This requires a substantial clearance between the holder and the countertop or lip of the sink to accommodate the hanging bar of soap. As the soap is used, the anchor becomes exposed and reveals sharp points and edges that can damage a user's skin In anchor style designs, the user is usually left with a small piece of soap attached to a large metal rod.

Cap style soap grippers allow suspension of a bar of soap in the same natural horizontal orientation as it would have if lying in a soap dish The holder height is typically high enough that it can suspend the bar over the sink basin itself. However, cap style soap grippers may require substantial force to insert them into hard soaps. At the same time, they can also easily pull out of soft soaps. As the soap erodes with use, the outer walls of the cap become exposed and the cap loses its holding strength U.S. Pat. No. 3,472,391 to Bolognesi a cap style soap gripper with serrated edges. The serrated edges make initial insertion into hard soaps easier. However, a user may be injured by the sharp edges of the cap as the bar of soap is worn down through use.

The holding strength of cap style soap grippers in soft soaps can be increased by either bending the walls of the cap outward as shown in U.S. Pat. No. 5,368,268 No. to Jodwischat or bending the walls of the cap inward as shown in U.S. Pat. No. 5,642,871 to Repert. However, the problem with bending the walls of the cap is that the force to insert the cap into hard soaps is exacerbated by the necessary displacement of a large amount of soap material.

Accordingly, there is a need for a device for attaching a bar of soap to a magnetic soap holder that is easy to install, maintains a solid grip on the bar of soap, and is made of a material attracted to magnetic fields and inert to the caustic environment of a bar of soap.

SUMMARY OF THE INVENTION

The present invention is a device for attaching a bar of soap to a magnetic soap holder. The device preferably comprises a sidewall with an open end on one end thereof and a closed end on the other end thereof opposite the open end. The sidewall and closed end having an inner surface and an outer surface. The inner surface of the sidewall preferably includes a plurality of grooves, indentations, or texturing formed therein. This texturing is preferably formed on the inner surface of the sidewall. The sidewall also preferably includes at least one opening extending therethrough, near the closed end of the device. The opening being preferably closer to the closed end than the open end. This opening allows trapped air inside the device to escape while a bottom edge of the sidewall is driven into a bar of soap.

The present invention provides several improvements to the cap style soap gripper for magnetic soap holders. First, while maintaining sufficient wall surface area, the diameter to height ratio can be reduced resulting in a cap that both requires less force for insertion into hard type soaps and is less affected by soap erosion. Second, by applying a grooved texture to the inside surface of the cap, the pullout force can be increased. Because the first improvement tends to increase wall height, it facilitates the second. Third, by coating the surface of the cap with powder paint, the cap surface energy is increased which improves the adhesive force of the soap and creates a greater pullout force. Fourth by installing the cap at an elevated temperature, the force to insert the disk is reduced and the resulting assembly is stronger and has an increased pullout force.

Various other features, objects, and advantages of the invention will be made apparent to those skilled in the art from the following detailed description, claims, and accompanying drawings.

DETAILED DESCRIPTION OF THE INVENTION

Figure 1:
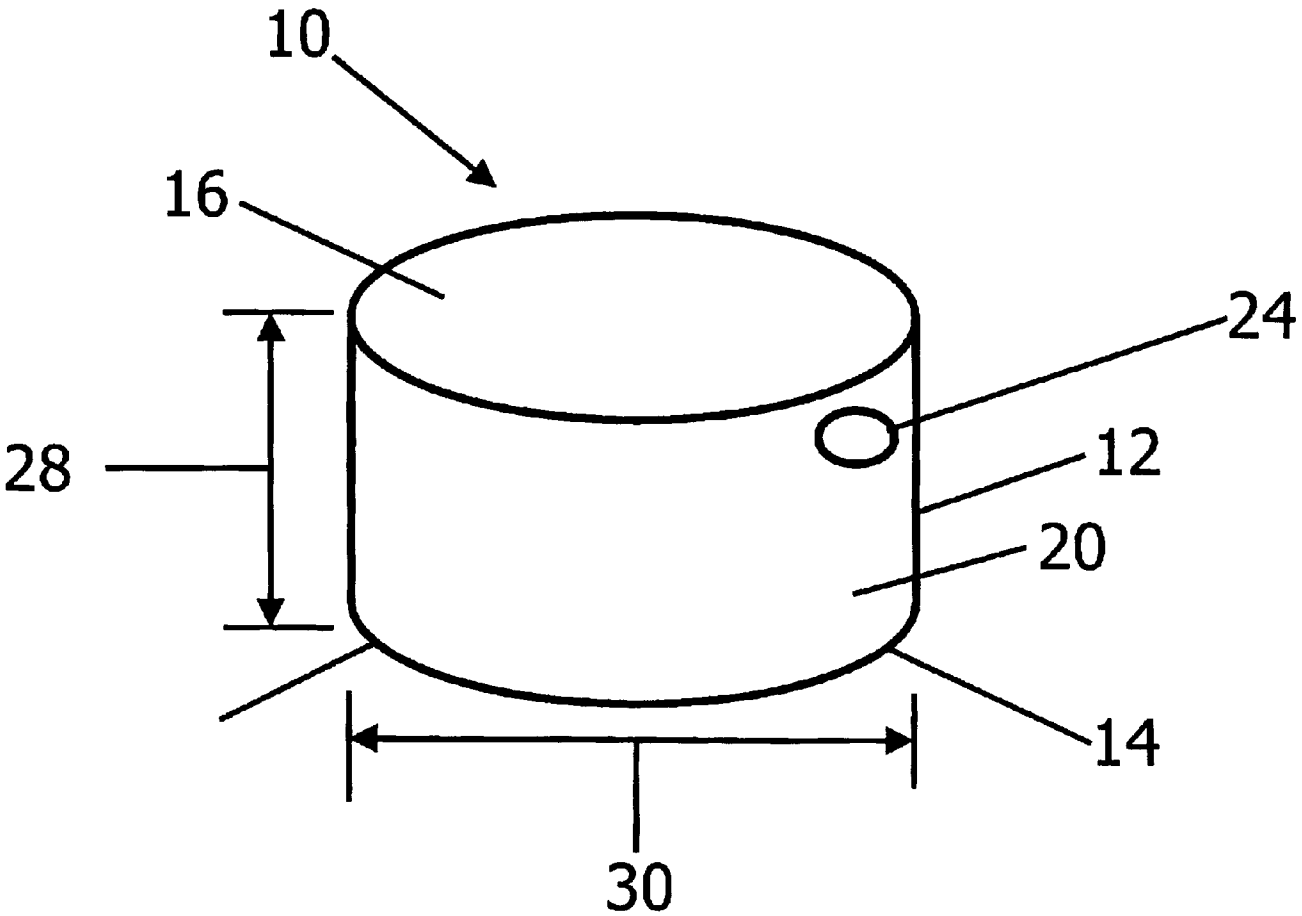
FIG. 1 is a top perspective view of a device for attaching a bar of soap to a magnetic soap holder in accordance with a preferred embodiment of the present invention.
Figure 2:
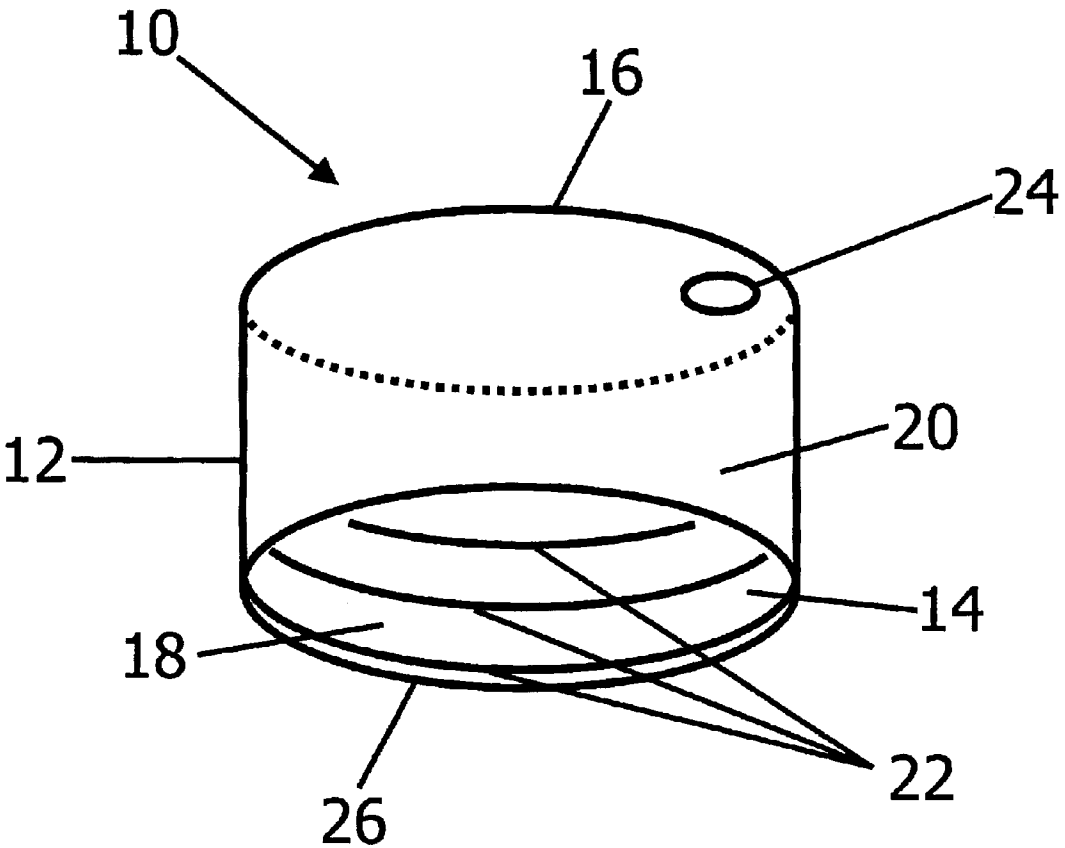
FIG. 2 is a bottom perspective view of the device of FIG. 1.

Referring DOW to the drawings, FIGS. 1 and 2 illustrate top and bottom perspective views, respectively, of a device 10 for attaching a bar of soap to a magnetic soap holder according to a preferred embodiment of the present invention. The device 10 comprises a sidewall 12 with an open end 14 on one end thereof and a closed end 16 on the other end thereof opposite the open end 14. The sidewall 12 and closed end 16 having an inner surface 18 and an outer surface 20. The inner surface 18 of the sidewall 12 preferably includes a plurality of grooves or indentations 22 formed therein. This texturing 22 is preferably formed on the inner surface 18 of the sidewall 12. The sidewall 12 also preferably includes at least one opening 24 extending therethrough, near the closed end 16 of the device 10. The opening 24 being preferably closer to the closed end 16 than the open end 14. This opening 24 allows trapped air inside the device 10 to escape while a bottom edge 26 of the sidewall 12 is driven into a bar of soap. FIG. 2 shows the device 10 tilted back to showing the inner surface 18 of the device 10. The device 10 is preferably cylindrically shaped having a cylindrical sidewall 12 with an open end 14 and a closed end 16. However, the device 10 of the present invention may be of any shape formed by a sidewall 12 with an open end 14 and a closed end 16.

Figure 3:
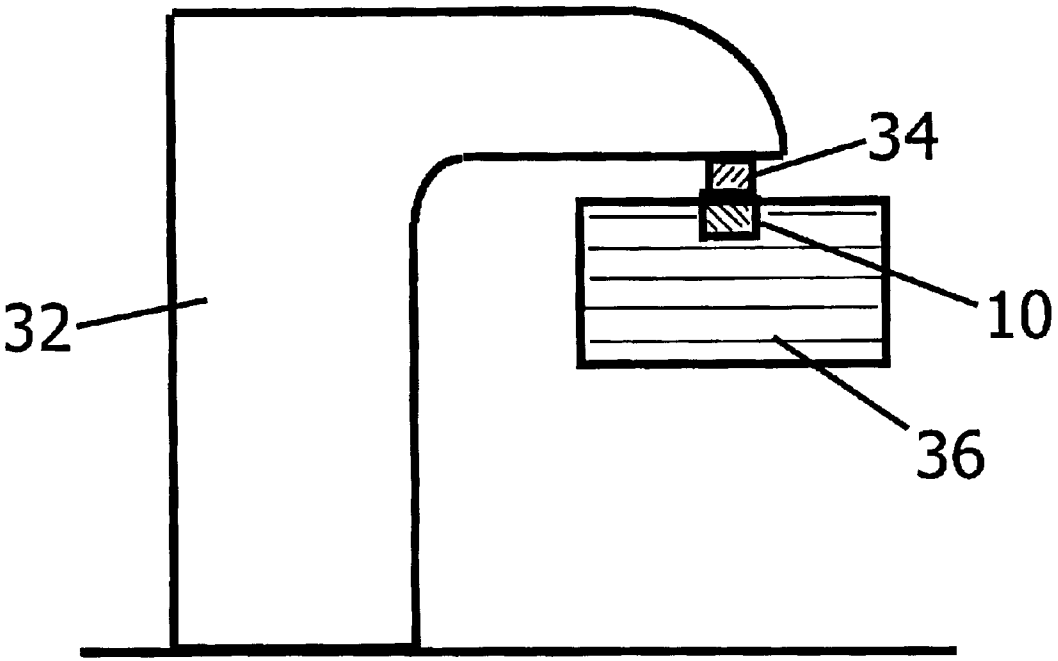
FIG. 3 is a partial cross-sectional view of the device of FIG. 1 inserted within a bar of soap and magnetically coupled to a magnet of a magnetic soap holder.

FIG. 3 shows a cross-sectional view of the device 10 imbedded in a bar of soap 36 hanging from a magnet 34 attached to a magnetic soap holder 32 as the device is intended to be used. As the device 10 is driven into a bar of soap 36, most of the insertion force required comes from the deformation and displacement of soap by the bottom edge 26 of the device 10. The greater the area represented by the bottom edge 26 the greater the force required. It is desirable to minimize this force to make insertion easier for a user and to prevent damage to the bar of soap 36.

One technique that only reduces the initial insertion force is to create a serrated pattern on the bottom edge 26 of the device. However, once the serrated pattern is totally inserted into the soap, the force builds to the same value it would have without it. The disadvantage of a serrated edge is that a user may be injured by contacting the sharp edges of the serrated pattern.

The present invention provides a better way to reduce the insertion force by reducing the circumferential area of the bottom edge 26. This is achieved by reducing the diameter 30 of the device. Once inserted, the device 10 must remain in the bar of soap during use. The force required to pull the device 10 out of a bar of soap is proportional to the total surface area of the outer 20 and inner 18 surfaces of the sidewall 12. Reducing the diameter 30 without changing the height 28 of the device would result in a loss of surface area and therefore a loss in pullout force. An increase in height 28 compensates for the reduction of the diameter 30 to maintain the pullout force.

As the bar of soap 36 is used, erosion takes place and the outer surface 20 of the sidewall 12 becomes exposed. This soap erosion is fairly constant over time, so the increased height 28 of the device 10 of the present invention is an advantage because it takes more time for a taller device to be fully exposed. By the time a taller device is fully exposed, the weight of the bar of soap is reduced by erosion thereby reducing the need for pullout strength.

A advantage to reducing the diameter 30 of the device 10 is that it allows more of the soap surface area to be exposed during use. In addition, because the soap inside the device does not erode, devices with smaller diameters do not need to be pulled out and re-inserted into the opposite side of the soap during the life of the bar of soap. The smaller diameter is also less distracting to a user, as some users do not like the idea of touching metal in a bar of soap.

Existing cap style soap grippers have a diameter to height ratio of about 5.7. The device of the present invention preferably has a diameter to height ratio of about 3.5 or less. This diameter to height ratio was not anticipated since previous inventors were forced to make the diameter of their cap style soap grippers relatively large to create enough attractive force when used with prior art ceramic magnets. New rare earth magnets provide enough magnetic force in a small area to allow the reduction of diameter while maintaining the magnetic force.

Referring again to FIG. 2, textured grooves or indentations22 are preferably formed on the inner surface 18 of the device 10 to increase the pullout force from the soap. The idea of texturing objects inserted into bars of soap to increase pullout force was applied to soap guards as disclosed in U.S. Pat. No. 3,108,392 to Sams. However, the texturing in that patent is molded into a plastic soap guard.

Figure 4A:
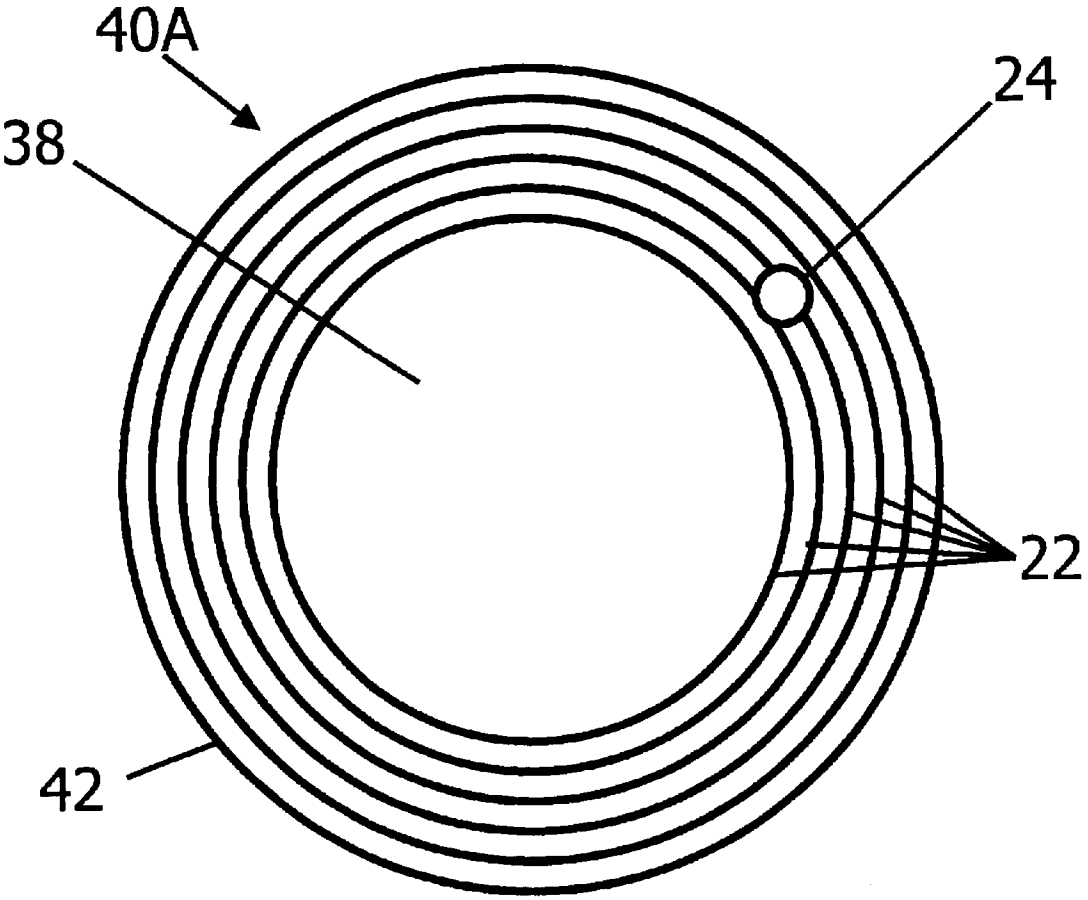
FIG. 4A is a top plan view of a sheet metal blank prior to forming a cap style soap gripper in accordance with the present invention.
Figure 4B:
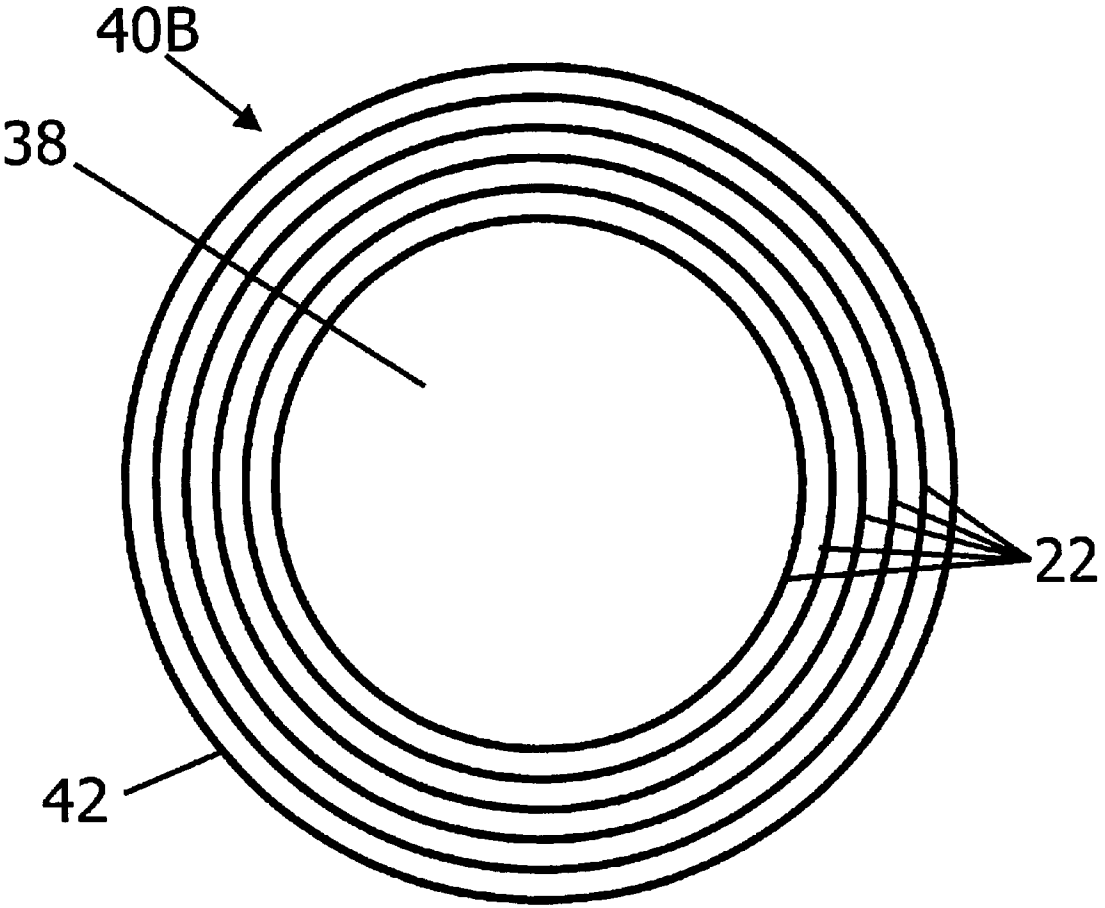
FIG. 4B is a top plan view of a sheet metal blank similar to the one shown in FIG. 4A, except that it does not include an opening extending through the sheet metal.

The present invention provides an economical method to apply texturing to the inner surface 18 of the device 10. Applying texturing is an additional step in the forming process already employed to create the device from sheet metal. FIGS. 4A and 4B show the sheet metal after being stamped into a blank. FIG. 4A shows the sheet metal blank 40A with an opening 24 punched in the sheet metal FIG. 4B shows the sheet metal blank 40B without an opening punched in the sheet metal In this method, the opening 24 is preferably drilled in the sidewall of the cap after it has been drawn from the sheet metal blank. The rings are grooves or indentations 22 textured in the surface of the sheet metal After drawing the blank 40A, 40B into the shape of a cap, the central region 38 of the blank becomes the underside of the closed end of the device, the textured area 22 becomes the side walls of the device, and the outer edge 42 becomes the bottom edge 26 of the device.

Figure 5:
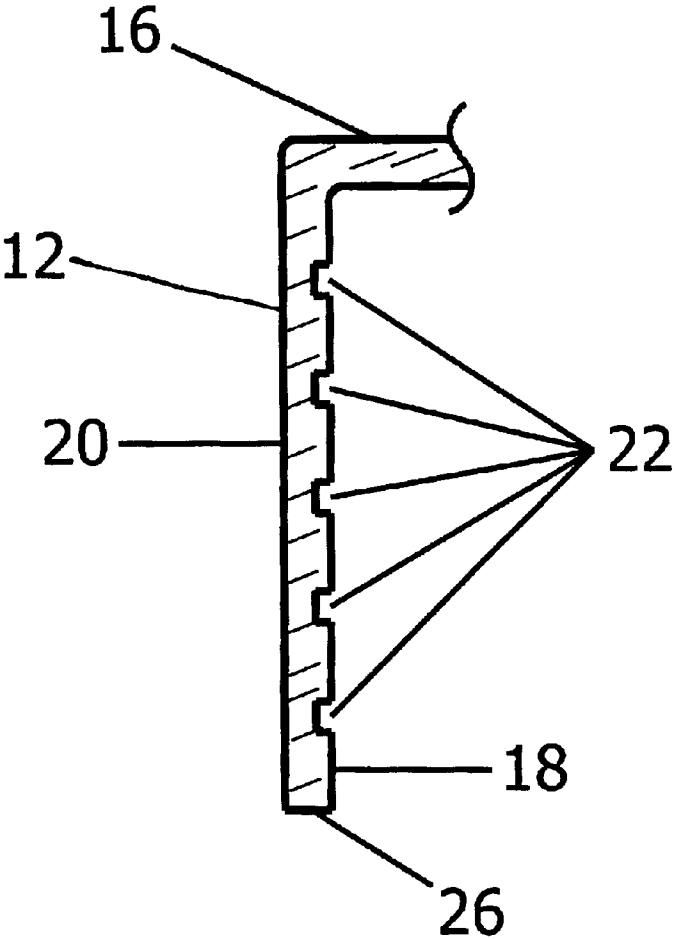
FIG. 5 is an enlarged cross-sectional view of a portion of a side wall and a portion of a top closed end of the cap style soap gripper of the present invention.
Figure 6:
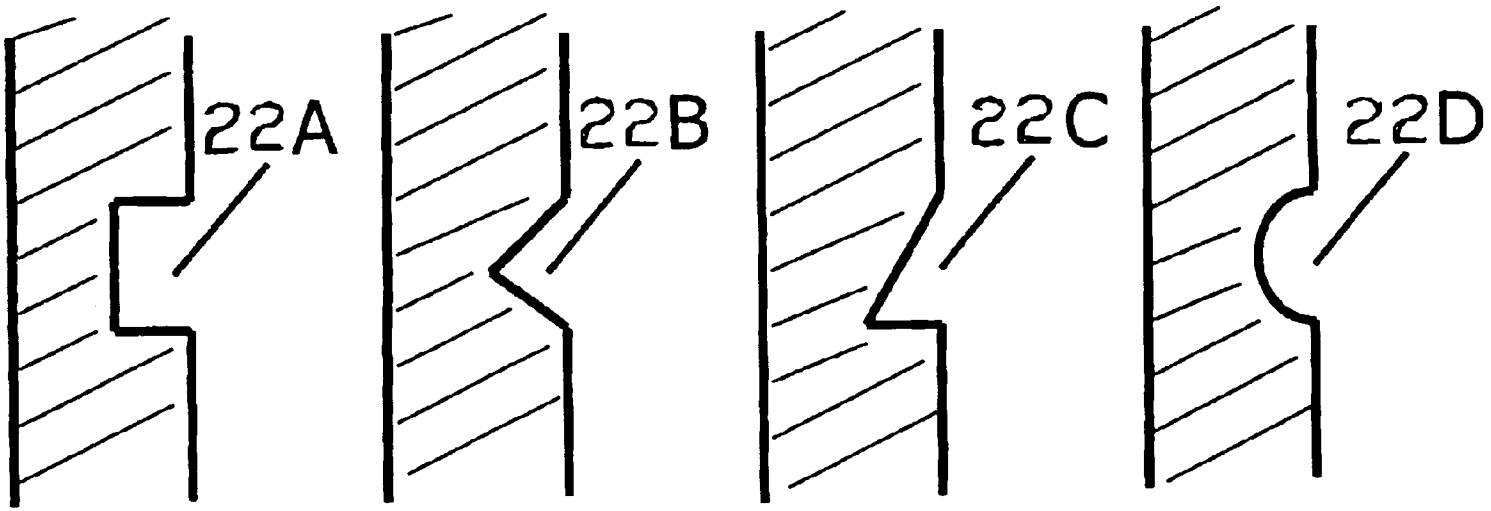
FIGS. 6A–6D are enlarged cross-sectional views of a portion of the sidewall of the cap style soap gripper showing various embodiments of groove shapes on the inside surface of the sidewall.

FIG. 5 illustrates a cross-sectional view of a portion of the sidewall 12 and closed end 16 of the device. In particular, FIG. 5 shows the textured grooves or indentations 22 formed on the inner surface 18 of the sidewall 12. These textured grooves or indentations 22 may be of many shapes and sizes. FIG. 6 illustrates a small number of the different possible shapes 22A, 22B, 22C, 22D. Because the pressure exerted by the soap onto the sidewall after insertion is large, soap material flows into these grooves 22 and locks the soap into place, thereby increasing the pullout force.

Although only five grooves 22 are illustrated in FIG. 5, many more could be used in an actual cap design. It should also be mentioned that the greater height 28 afforded by decreasing the diameter to height ratio allows more texturing. The two improvements of more height and more texturing complement each other and provide a better cap design Additionally, the texturing does not need to be in the form of any particular shape. It could be a roughening of the inner surface by any pattern of grooves, indentations, etc.

The present invention also recognize that the soap is behaving like an adhesive to hold the cap style soap gripper in place. Adhesion is a molecular force of attraction between unlike materials. The strength of attraction is determined by the surface energy of the two materials. The greater the surface energy, the greater the attraction. Normally metals have a relatively large surface energy as is the case for a cap style soap gripper made from stainless steel. However coating materials can be applied to metal surfaces that not only increase the surface energy, but also make the surface more durable and chemical resistant. A cap coated with this type of material, such as powder coating, exhibits greater pullout force since the soap adhesion is increased. The device of the present invention is preferably made with these types of materials. The cap coating may also be color matched to blend in with the color of the soap.

Finally, the method of the present invention includes elevating the temperature of the cap style gripper to allow insertion of the cap into the soap with less force. Elevating the temperature of the cap prior to insertion into the soap also causes less damage to the soap. After the temperature returns to normal, the bond between the cap and the soap is better than for a cap inserted into the soap at room temperature. This is because the soap is able to flow more completely into the texturing formed on the inner surface of the sidewall of the cap at a temperature closer to the melting point of the soap.

The preferred method of the present invention includes the following steps. Stamping a circular blank from a sheet of stainless steel alloy of a type, such as AL29-4C from Allegheny Ludlum of Skokie, Illinois. This material is both attracted to magnetic fields and inert to the caustic environment of a bar of soap. An opening may then be punched in the circular blank, or drilled in the sidewall after drawing the sheet metal into a cap shape. The blank is indented with texturing. The blank is then preferably drawn into the shape of a cap. The final diameter of the cap is preferably 16 mm (0.63 in) and the sidewall height 12 is preferably 5 nun (0.19 in) giving a diameter to height ratio of 3.2. The cap may then be coated with a powder or paint coating to increase the cap surface energy. Just before insertion into a bar of soap, the temperature of the cap may be raised to at least 93 degrees Celsius (200-degrees-Fahrenheit)-to-reduce-the-insertion-force and increase the pullout strength of the cap.

While the invention has been described with reference to preferred embodiments, it is to be understood that the invention is not intended to be limited to the specific embodiments set forth above. It is recognized that those skilled in the art will appreciate that certain substitutions, alterations, modifications, and omissions may be made without departing from the spirit or intent of the invention. Accordingly, the foregoing description is meant to be exemplary only, the invention is to be taken as including all reasonable equivalents to the subject matter of the invention, and should not limit the scope of the invention set forth in the following claims.

We claim:

1. An improved cap style soap gripper for a magnetic soap holder, comprising:

a metallic body having a top portion and a sidewall portion, the top and sidewall portions having an inside surface and an outside surface:

at least one hole extending through the sidewall portion of the metallic body for allowing air to escape during insertion of the metallic body into a bar of soap;

textured grooves formed on the inside surface of the sidewall of the metallic body;

wherein the top portion includes a diameter, wherein the sidewall portion includes a height, and wherein the diameter to height ratio is 3.5 or less; and wherein the diameter is 16 millimeters and wherein the height is 5 millimeters.

2. The improved cap style soap gripper of claim 1, wherein the metallic body includes a powder paint coating.

3. The improved cap style soap gripper of claim 1, wherein the metallic body is formed of a material inert to the caustic environment of a bar of soap, and wherein the metallic body is formed of a material that is attracted to magnetic fields.

4. The improved cap style soap gripper of claim 3, wherein the material is a stainless steel alloy.

5. The improved cap style soap gripper of claim 1, wherein the temperature of the metallic body includes a surface temperature, the surface temperature being elevated prior to insertion into a bar of soap.

6. The improved cap style soap gripper of claim 5, wherein the surface temperature is at least 93 degrees Celsius.

7. A method of manufacturing a cap style soap gripper, the method comprising the steps of:

stamping a circular blank from a metallic material;

indenting the circular blank with a pattern of grooves;

forming at least one opening through of the circular blank;

drawing the circular blank into a cap shape, wherein the grooves are located on the inside surface of the cap, and wherein the hole is located on the side wall of the cap;

forming at least one opening in a sidewall of the drawn cap;

coating the cap with powder paint; and elevating the temperature of the cap just prior to insertion into a bar of soap.

8. The method of claim 7, further comprising the step of elevating the temperature to at least 93 degrees Celsius.

9. The method of claim 7, further comprising the step of indenting the circular blank with a plurality of texturing.

* * * * *